US005342819A

United States Patent [19]

Takiguchi et al.

[11] Patent Number: 5,342,819

[45] Date of Patent: Aug. 30, 1994

[54] THERMAL TRANSFER IMAGE-RECEIVING SHEET

[75] Inventors: Ryohei Takiguchi; Hitoshi Saito; Masanori Torii; Jun hasegawa, all of Tokyo, Japan

[73] Assignee: Dai Nippon Printing Co., Ltd., Japan

[21] Appl. No.: 972,034

[22] Filed: Nov. 6, 1992

[30] Foreign Application Priority Data

Nov. 12, 1991 [JP] Japan ..... 3-322426
Dec. 13, 1991 [JP] Japan ..... 3-351299

[51] Int. Cl.[5] ..... B41M 5/035; B41M 5/38

[52] U.S. Cl. ..... 503/227; 428/195; 428/412; 428/480; 428/913; 428/914

[58] Field of Search ..... 8/471; 428/195, 412, 428/480, 913, 914; 503/227

[56] References Cited

U.S. PATENT DOCUMENTS 4,748,151 5/1988 Murata et al. ..... 503/227
4,897,377 1/1990 Marbrou ..... 503/227
4,908,345 3/1990 Egashira et al. ..... 503/227

FOREIGN PATENT DOCUMENTS 0475633 3/1992 European Pat. Off. ..... 503/227
3626422 2/1987 Fed. Rep. of Germany ..... 503/227

*Primary Examiner*—B. Hamilton Hess
*Attorney, Agent, or Firm*—Parkhurst, Wendel & Rossi

[57] ABSTRACT

The present invention provides a thermal transfer image-receiving sheet which can form an image excellent in the coloring density, sharpness and various types of fastness, particularly durability such as light fastness, fingerprint resistance and plasticizer resistance according to a thermal transfer printing process wherein use is made of a sublimable dye, and can be easily produced by conventional coating equipment through the use of a non-halogenated hydrocarbon solvent, such as a ketone solvent, a toluene solvent or a mixture thereof.

A first embodiment of the invention is directed to a thermal transfer image-receiving sheet including a substrate sheet and a dye-receiving layer formed on at least one surface of the substrate sheet, wherein the dye-receiving layer includes a random copolycarbonate resin having structural units represented by the following general formulae (1) and (2), the molar ratio of the structural unit represented by the general formula (1) to the structural unit represented by the general formula (2) being 30:70 to 70:30

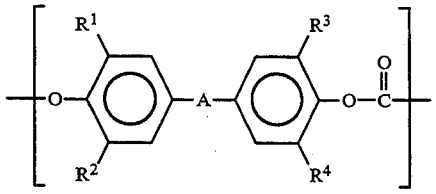

(1)

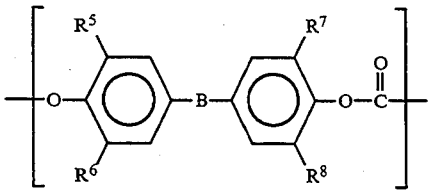

(2)

wherein $R^1$ to $R^8$ stand for hydrogen, a halogen or an alkyl group having 1 to 4 carbon atoms, A stands for a straight-chain, branched or cyclic alkylidene group having 1 to 10 carbon atoms, an aryl-substituted alkylidene group, an aryl group or a sulfonyl group and B stands for an oxygen atom or a sulfur atom.

The second invention is directed to a thermal transfer image-receiving sheet comprising a substrate sheet and a dye-receiving layer formed on at least one surface of the substrate sheet, wherein said dye-receiving layer comprises at least a polycarbonate resin and an aromatic polyester resin.

11 Claims, No Drawings

THERMAL TRANSFER IMAGE-RECEIVING SHEET

BACKGROUND OF THE INVENTION

The present invention relates to a thermal transfer sheet and more particularly to a thermal transfer image-receiving sheet capable of forming a record image excellent in the color density, sharpness and various types of fastness, particularly durability such as light fastness, fingerprint resistance and plasticizer resistance.

Various thermal transfer printing processes are known in the art. One of them is a transfer printing process which comprises supporting a sublimable dye as a recording agent on a substrate sheet, such as a polyester film, to form a thermal transfer sheet and forming various full color images on an image-receiving sheet dyeable with a sublimable dye, for example, an image-receiving sheet comprising paper, a plastic film or the like and, formed thereon, a dye-receiving layer.

In this case, a thermal head of a printer is used as heating means, and a number of color dots of three or four colors are transferred to the image-receiving material, thereby reproducing a full color image of an original by means of the multicolor dots.

Since the color material used is a dye, the image thus formed is very clear and highly transparent, so that the resultant image is excellent in the reproducibility and gradation of intermediate colors. Therefore, according to this method, the quality of the image is the same as that of an image formed by the conventional offset printing and gravure printing, and it is possible to form an image having a high quality comparable to a full color photographic image.

Not only the construction of the thermal transfer sheet but also the construction of an image-receiving sheet for forming an image are important for usefully practicing the above-described thermal transfer process.

For example, Japanese Patent Laid-Open Publication Nos. 1639370/1982, 207250/1982 and 25793/1985 disclose prior art techniques applicable to the above-described thermal transfer image-receiving sheet, wherein the dye-receiving layer is formed by using vinyl resins such as a polyester resin, a polyvinyl chloride, a polycarbonate resin, a polyvinyl butyral resin, an acrylic resin, a cellulose resin, an olefin resin and a polystyrene resin.

In the above-described thermal transfer image-receiving sheet, the dyeability of the dye-receiving layer and various types of durability and storage stability of an image formed thereon greatly depend upon the kind of the resin constituting the dye-receiving layer.

The dyeing capability of the dye which is transferred can be improved by improving the diffusivity of the dye at the time of the thermal transfer through the formation of the dye-receiving layer from a resin having a good dyeability or the incorporation of a plasticizer in the dye-receiving layer. In the dye-receiving layer comprising the above-described resin having a good dyeability, the formed image blurs during storage. Therefore, the storage stability is poor or the the fixability of the dye is poor, so that the dye bleeds out on the surface of the image-receiving sheet, which causes other articles in contact with the surface of the sheet to be liable to staining.

The above-described problems of storage stability and staining can be solved by selecting such a resin that the dye transferred to the dye-receiving layer is less liable to migration within the dye-receiving layer. In this case, however, the dyeing property of the dye is so poor that it is impossible to form an image having a high density and a high sharpness.

There are other large problems such as the light fastness of transferred dye, fading of the formed image due to sweat or sebum migrated to the image surface when the hand touches the image portion, swelling or cracking of the image-receiving layer per se, fingerprint resistance, bleeding of the dye when the dye is in contact with a substance containing a plasticizer, such as an eraser or a soft vinyl chloride resin, that is, a plasticizer resistance.

Examples of the resin having an excellent light fastness include polycarbonate resins, and various polycarbonate resins are disclosed in Japanese Patent Laid-Open Nos. 19138/1985, 169694/1987, 202791/1987 and 301487/1990. However, conventional polycarbonate resins are poor in the fingerprint resistance, and the solubility of the bisphenol A polycarbonate resin described as a favorable resin in the above-described documents is so poor that it is necessary for the coating to be conducted through the use of a chlorinated hydrocarbon solvent such as methylene chloride or chloroform, which is unfavorable from the viewpoint of the work environment.

Examples of the polycarbonate resin having a good solubility and coatable in the form of a solution thereof in a non-halogenated hydrocarbon solvent, such as a ketone solvent, a toluene solvent or a mixture thereof include polycarbonate resins represented by the following structural formula:

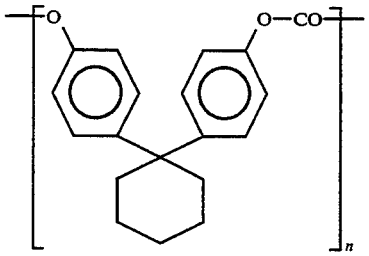

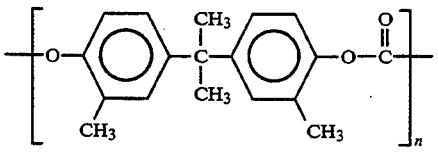

These polycarbonate resins, however, are disadvantageously poor in the fingerprint resistance and plasticizer resistance.

Accordingly, an object of the present invention is to provide a thermal transfer image-receiving sheet which can form an image excellent in the coloring density, sharpness and various types of fastness, particularly durability such as light fastness, fingerprint resistance and plasticizer resistance according to a thermal transfer printing process wherein use is made of a sublimable dye, and can be easily produced by conventional coating equipment through the use of a non-halogenated hydrocarbon solvent, such as a ketone solvent, a toluene solvent or a mixture thereof.

The above-described object can be attained by the following present invention. According to the first aspect of the present invention, there is provided a thermal transfer image-receiving sheet comprising a substrate sheet and a dye-receiving layer formed on at least one surface of the substrate sheet, wherein said dye-receiving layer comprises a random copolycarbonate resin having structural units represented by the following general formulae (1) and (2), the molar ratio of the structural unit represented by the general formula (1) to the structural unit represented by the general formula (2) being 30:70 to 70:30

(1)

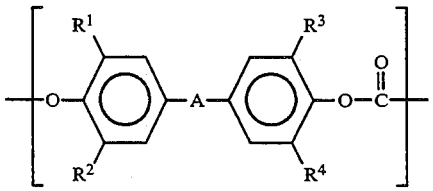

(2)

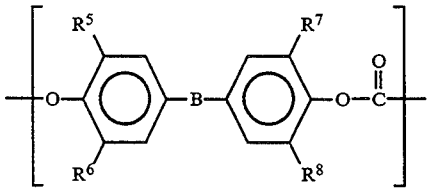

wherein $R^1$ to $R^8$ stand for hydrogen, a halogen or an alkyl group having 1 to 4 carbon atoms, A stands for a straight-chain, branched or cyclic alkylidene group having 1 to 10 carbon atoms, an aryl-substituted alkylidene group, an aryl group or a sulfonyl group and B stands for an oxygen atom or a sulfur atom.

The formation of the dye-receiving layer through the use of a polycarbonate resin having the above-described particular structure can provide a thermal transfer image-receiving sheet which can form an image excellent in the coloring density, sharpness and various types of fastness, particularly durability such as light fastness, fingerprint resistance and plasticizer resistance according to a thermal transfer printing process wherein use is made of a sublimable dye, and can be easily produced by conventional coating equipment through the use of a non-halogenated hydrocarbon solvent, such as a ketone solvent, a toluene solvent or a mixture thereof.

According to the second aspect of the present invention, there is provided a thermal transfer image-receiving sheet comprising a substrate sheet and a dye-receiving layer formed on at least one surface of the substrate sheet, wherein said dye-receiving layer comprises at least a polycarbonate resin having the above structure and an aromatic polyester resin.

The formation of the dye-receiving layer through the use of a polycarbonate resin and an aromatic polyester resin can provide a thermal transfer image-receiving sheet which can form an image excellent in the coloring density, sharpness and various types of fastness, particularly durability such as light fastness, fingerprint resistance and plasticizer resistance according to a thermal transfer printing process wherein use is made of a sublimable dye, and can be easily produced by conventional coating equipment through the use of a non-halogenated hydrocarbon solvent, such as a ketone solvent, a toluene solvent or a mixture thereof. Since the dyeing capability of the dye can be further improved by mixing the polycarbonate resin with the aromatic polyester resin, the thermal transfer image-receiving sheet according to the second aspect of the present invention can further improve the coloring density, fingerprint resistance and plasticizer resistance as compared with the thermal transfer image-receiving sheet according to the first aspect of the present invention.

DETAILED DESCRIPTION OF THE INVENTION

The present invention will now be described in more detail with reference to the following preferred embodiments of the present invention.

The thermal transfer image-receiving sheet of the present invention comprises a substrate sheet and a dye-receiving layer formed on at least one surface of the substrate sheet.

There is no particular limitation on the substrate sheet used in the present invention, and examples of the substrate sheet useable in the present invention include synthetic paper (polyolefin, polystyrene and other synthetic paper), wood free paper, art paper, coat paper, cast coat paper, wall paper, paper for backing, paper impregnated with a synthetic resin or an emulsion, paper impregnated with a synthetic rubber latex, paper containing an internally added synthetic resin, fiber board, etc., cellulose fiber paper, and films or sheets of various plastics such as polyolefin, polyvinyl chloride, polyethylene terephthalate, polystyrene, polymethacrylate and polycarbonate. Further, use may be made of a white opaque film or a foamed sheet prepared by adding a white pigment or filler to the above-described synthetic resin and forming a film from the mixture or foaming the mixture.

Further, use may be made of a laminate comprising any combination of the above-described substrate sheets. Typical examples of the laminate include a laminate comprising a combination of a cellulose fiber paper with a synthetic paper and a laminate comprising a combination of a cellulose fiber paper with a plastic film or sheet. The thickness of these substrate sheets may be arbitrary and is generally in the range of from 10 to 300 $\mu$m.

When the substrate sheet is poor in the adhesion to a receiving layer formed on the surface thereof, it is preferred that the surface of the substrate sheet be subjected to a primer treatment or a corona discharge treatment.

The receiving layer formed on the surface of the substrate sheet serves to receive a sublimable dye moved from the thermal transfer sheet and to maintain the formed image.

In the first invention, the resin for forming the dye-receiving layer is composed mainly of the above-described particular polycarbonate resin.

Although the polycarbonate resin may be used alone, it may be used in the form of a blend with any known other resin useable as the receiving layer resin for the purpose of forming an image having a higher density and a higher sharpness. It is particularly preferred for the polycarbonate resin to be used in the form of a blend with a polyester resin.

When the compatibility of the polycarbonate resin with other resin in the blending and the solubility in a solvent are taken into consideration, the number average molecular weight of the polycarbonate resin is preferably 5,000 to 50,000, more preferably 5,000 to 25,000.

The solubility and dissolution stability of the polycarbonate resin according to the present invention in a general-purpose resin and the improvement in the fingerprint resistance and plasticizer resistance develop by virtue of random copolymerization of the above-described two structural units, and no satisfactory performance can be attained when the copolymer is a block copolymer.

In the random copolycarbonate resin used in the present invention, the molar ratio of the structural unit (1) to the structural unit (2) is preferably 30:70 to 70:30. If the molar ratio is outside the above-described range, the randomness of the copolymer is broken, so that the property becomes close to that of the block copolymer. For this reason, the preparation of a polycarbonate resin solution causes the resultant solution to become opaque or the solution stability to be lowered. When the number average molecular weight is less than 5,000, the strength of the dye-receiving layer formed by coating is liable to become insufficient. On the other hand, when it exceeds 50,000, the productivity of the coating is unfavorably liable to lower.

In the copolycarbonate resin used in the present invention, examples of dihydric phenol which leads to the structural unit represented by the general formula (1) include bis(4-hydroxyphenyl)methane, 1,1-bis(4-hydroxyphenyl)ethane, 2,2-bis(4-hydroxyphenyl)propane (bisphenol A; BPA), 2,2-bis(4-hydroxyphenyl)butane, 1,1-bis(4-hydroxyphenyl)cyclohexane (bisphenol Z; BPZ), 2,2-bis(4-hydroxy-3,5-dimethylphenyl)propane, 2,2-bis(4-hydroxy-3,5-dibromophenyl)propane, 2,2-bis(4-hydroxy-3,5-dichlorophenyl)propane, 2,2-bis(4-hydroxy-3-methylphenyl)propane (dimethylbisphenol A; DMBPA), 2,2-bis(4-hydroxy-3-bromphenyl)propane, 2,2-bis(4-hydroxy-3-chlorophenyl)propane, 1,1-bis(4-hydroxyphenyl)-1-phenylethane, bis(4-hydroxyphenyl)diphenylmethane and bis(4-hydroxyphenyl)sulfone. Among them, 2,2-bis(4-hydroxyphenyl)propane, 1,1-bis(4-hydroxyphenyl)cyclohexane, 1,1-bis(4-hydroxyphenyl)-1-phenylethane, 2,2-bis(4-hydroxy-3-methylphenyl)propane and bis(4-hydroxyphenyl)sulfone are preferred, and 2,2-bis(4-hydroxyphenyl)propane and 1,1-bis(4-hydroxyphenyl)cyclohexane are particularly preferred from the viewpoint of thermal stability.

In the copolycarbonate resin used in the present invention, examples of dihydric phenol which leads to the structural unit represented by the general formula (2) include bis(4-hydroxyphenyl)ether (4,4-dihydroxydiphenyl ether; DHPE), bis(3-methyl-4-hydroxyphenyl)ether (3,3'-dimethyl-4,4'-dihydroxydiphenyl ether; DMDHPE), bis(3-bromo-4-hydroxyphenyl)ether, bis(3-chloro-4-hydroxyphenyl)ether, bis(3,5-dimethyl-4-hydroxphenyl)ether, bis(3,5-dibromo-4-hydroxyphenyl)ether, bis(3,5-dichloro-4-hydroxyphenyl)ether, bis(4-hydroxyphenylsulfide), bis(3-methyl-4-hydroxyphenyl) sulfide, bis(3-bromo-4-hydroxyphenyl)sulfide, bis(3-chloro-4-hydroxyphenyl)sulfide, bis(3,5-dimethyl-4-hydroxyphenyl)sulfide, bis(3,5-dibromo-4-hdyroxyphenyl)sulfide and bis(3,5-dichloro-4-hydroxyphenyl)sulfide. Among them, bis(4-hydroxyphenyl)ether and bis(4-hydroxyphenyl) sulfide are preferred.

The polycarbonate resin may be prepared by a known production process.

In the present invention, the polycarbonate resin, as such, may be used. Alternatively, it may be used after modification such as conversion to urethane. Further, it may be used alone or in the form of a mixture thereof. For example, it is also possible to use the polycarbonate resin in combination with a polyolefin resin such as polypropylene, a halogenated polymer such as polyvinylidene chloride, polyvinyl chloride, a polyester resin, a vinyl polymer such as polyvinyl acetate or polyacrylic ester, a polystyrene resin, a polyamide resin, a resin of a copolymer of an olefin such as ethylene or propylene with other vinyl monomer, an ionomer, a cellulose resin such as cellulose diacetate, a polyvinyl acetal resin, a polycaprolactone resin and a polyethylene glycol resin.

The resin constituting the receiving layer may be thermoset with a polyisocyanate for the purpose of further improving the fingerprint resistance and plasticizer resistance. In this case, since crosslinking occurs in the polycarbonate, it is preferred to properly add a resin having a high active hydrogen content such as an acrylic resin, a polyvinylacetal resin or a polyurethane resin or a polyol compound as a monomer for the purpose of attaining a better effect. Alternatively, it is also possible to use a method wherein an acrylic monomer such as urethane acrylate, polyester acrylate, epoxy acrylate or polyether acrylate is added and the mixture is subjected to crosslinking with an ultraviolet radiation or an electron beam.

The thermal transfer image-receiving sheet according to the second aspect of the present invention will now be described.

In this thermal transfer image-receiving sheet, the resin constituting the dye-receiving layer comprises a mixture of a polycarbonate resin with an aromatic polyester resin. Although the polycarbonate resin may be any known polycarbonate resin, a particularly preferred polycarbonate resin is a random copolycarbonate resin which comprises structural units represented by the above-described general formulae (1) and (2) and wherein the molar ratio of the structural unit represented by the general formula (1) to the structural unit represented by the general formula (2) is 30:70 to 70:30.

In the random copolycarbonate resin used in the present invention, the molar ratio of the structural unit (1) to the structural unit (2) is preferably 30:70 to 70:30. If the molar ratio is outside the above-described range, the preparation of a polycarbonate resin solution causes the solution to become opaque or the solution stability to be lowered. As compared with block copolymerization, random copolymerization provides a more homogeneous micro dispersion and improves the solution stability, fingerprint resistance and plasticizer resistance. When the number average molecular weight is less than 5,000, the strength of the dye-receiving layer formed by coating tends to become unsatisfactory. On the other hand, when it exceeds 50,000, the productivity of the coating is unfavorably liable to lower. For this reason, the number average molecular weight of the polycarbonate resin is preferably in the range of from 5,000 to 50,000, more preferably in the range of from 5,000 to 25,000.

In the copolycarbonate resin used in the second aspect of the present invention, examples of dihydric phenol which leads to the structural unit represented by the general formula (1) include bis(4-hydroxyphenyl)methane, 1,1-bis(4-hydroxyphenyl)ethane, 2,2-bis(4-hydroxyphenyl)propane (bisphenol A; BPA), 2,2-bis(4-hydroxyphenyl)butane, 1,1-bis(4-hydroxyphenyl)-cyclohexane (bisphenol Z; BPZ), 2,2-bis(4-hydroxy-3,5-dimethylphenyl)propane, 2,2-bis(4-hydroxy-3,5-dibromophenyl) propane, 2,2-bis(4-hydroxy-3,5-dichlorophenyl)propane, 2,2-bis(4-hydroxy-3-methylphenyl)propane (dimethylbisphenol A; DMBPA), 2,2-bis(4-hydroxy-3-bromphenyl) propane, 2,2-bis(4-hydroxy-3-chlorophenyl)propane, 1,1-bis(4-hydroxyphenyl)-1-phenylethane, bis(4-hydroxyphenyl)diphenylmethane and bis(4-hydroxyphenyl)sulfone. Among them, 2,2-bis(4-hydroxyphenyl)propane, 1,1-bis(4-hdyroxyphenyl)cyclohexane, 1,1-bis(4-hydroxyphenyl)-1-phenylethane, 2,2-bis(4-hydroxy-3-methylphenyl)propane and bis(4-hydroxyphenyl)sulfone are preferred, and 2,2-bis(4-hydroxyphenyl)propane and 1,1-bis(4-hydroxyphenyl)cyclohexane are particularly preferred from the viewpoint of thermal stability.

In the copolycarbonate resin used in the second aspect of the present invention, examples of dihydric phenol which leads to the structural unit represented by the general formula (2) include bis(4-hydroxyphenyl)ether (4,4-dihydroxydiphenyl ether; DHPE), bis(3-methyl-4-hydroxyphenyl)ether (3,3'-dimethyl-4,4'-dihydroxydiphenyl ether; DMDHPE), bis(3-bromo-4-hydroxyphenyl)ether, bis(3-chloro-4-hydroxyphenyl)ether, bis(3,5-dimethyl-4-hydroxphenyl)ether, bis(3,5-dibromo-4-hydroxyphenyl)ether, bis(3,5-dichloro-4-hydroxyphenyl)ether, bis(4-hydroxyphenylsulfide), bis(3-methyl-4-hydroxyphenyl)sulfide, bis(3-bromo-4-hydroxyphenyl)sulfide, bis(3-chloro-4-hydroxyphenyl)-sulfide, bis(3,5-dimethyl-4-hydroxyphenyl)sulfide, bis(3,5-dibromo-4-hdyroxyphenyl)sulfide and bis(3,5-dichloro-4-hydroxyphenyl)sulfide. Among them, bis(4-hydroxyphenyl)ether and bis(4-hydroxyphenyl)sulfide are preferred.

The polycarbonate resin may be prepared by a known production process.

Although any known aromatic polyester resin may be used as an aromatic polyester resin for forming a dye-receiving layer in combination with the above-described polycarbonate resin, the aromatic polyester resin is particularly preferably one composed mainly of an aromatic polyester resin wherein an alicyclic compound is contained in at least one of the polydiol moiety and the acid moiety.

Any alicyclic compound may be used for this purpose so far as it contains at least two carboxyl groups in the case of the acid moiety and at least two hydroxyl group in the case of the diol moiety. Preferred examples of the alicyclic compound include tricyclodecanedimethanol (abbreviation: TCD-M), cyclohexanedicarboxylic acid, cyclohexanedimethanol and cyclohexanediol. Although there is no particular limitation on the diol, particularly preferred examples of the diol include TCD-M (alias: tricyclo[5.2.1.$0^{2,6}$]decane-4,8-dimethanol) represented by the following structural formula:

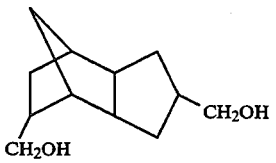

Other acid moiety and diol moiety may be used in combination with the above-described compound so far as the above-described compound is as an indispensable component in the acid moiety or diol moiety. Examples of such a diol include ethylene glycol, neopentyl glycol, diethylene glycol, propylene glycol, dipropylene glycol, tripropylene glycol, 2,3,4-trimethyl-1,3-pentanediol, 3-methylpentene-1,5-diol, 1,4-cyclohexanedimethanol, an ethylene oxide or propylene oxide adduct of bisphenol A or hydrogenated bisphenol A, polyethylene glycol, polypropylene glycol, polytetramethylene glycol, polybutylene glycol, 2,2-diethyl-1,3-propanediol and 2-n-butyl-ethyl-1,3-propanediol.

These other diols may be used in an amount in the range of from 0 to 90% by weight based on the whole diol moiety. In order to further improve the fingerprint resistance and the plasticizer resistance, it is preferred that use is made of such a formulation that ethylene glycol occupies 60 to 90% by weight of the diol moiety. When the ethylene glycol content is excessively high, the effect of improving the light fastness and heat resistance becomes unsatisfactory. For this reason, when importance is attached to the light fastness and heat resistance, it is preferred to increase the proportion of the alicyclic compound.

Examples of acid moiety other than cyclohexanedicarboxylic acid which is reacted with the above-described diol include aromatic dicarboxylic acids such as terephthalic acid, isophthalic acid, o-phthalic acid and 2,6-naphthalic acid, aromatic oxycarboxylic acids such as p-oxybenzoic acid and p-(hydroxyethoxy)benzoic acid, aliphatic dicarboxylic acids such as succinic acid, adipic acid, azelaic acid, sebacic acid and dodecanedicarboxylic acid, unsaturated aliphatic and alicyclic dicarboxylic acids such as fumaric acid, maleic acid, itaconic acid, tetrahydrophthalic acid and 1,4-cyclohexanedicarboxylic acid, and tri- and tetracarboxylic acids such as trimellitic acid, trimesic acid and pyromellitic acid. Among these polycarboxylic acids, the aromatic dicarboxylic acids are particularly preferred.

The aromatic polyester may be produced by a known process such as dehydrocondensation or transesterification condensation. It is preferred for the polyester resin to have a molecular weight in the range of from 2,000 to 30,000 in terms of number average molecular weight and a Tg value in the range of from 60° to 90° C.

In the present invention, the above-described polycarbonate resin and/or aromatic polyester resin, as such, may be used. Alternatively, they may be used after modification such as conversion to urethane or in combination with other resin. Examples of the other resin which may be used in combination with the polycarbonate resin and/or the aromatic polyester resin include a polyolefin resin such as polypropylene, a halogenated polymer such as polyvinyl chloride and polyvinylidene chloride, a vinyl polymer such as polyvinyl acetate or polyacrylic ester, a polystyrene resin, a polyamide resin, a resin of a copolymer of an olefin such as ethylene or propylene with other vinyl monomer, an ionomer, a cellulose resin such as cellulose diacetate, a polyvinyl acetal resin, a polycaprolactone resin and a polyethylene glycol resin.

The mixing ratio of the polycarbonate to polyester resin used in the present invention is preferably in the range of from 10:90 to 90:10 in terms of the weight ratio. The object of the present invention can be most effectively attained when the weight ratio falls within the above-described range.

The resin constituting the receiving layer may be thermoset with a polyisocyanate for the purpose of further improving the fingerprint resistance and plasticizer resistance. In this case, since crosslinking occurs only at the terminal hydroxyl group of the polycarbonate resin or polyester resin, it is preferred to properly add a resin having a high active hydrogen content such as an acrylic resin, a polyvinylacetal resin or a polyurethane resin or a polyol compound as a monomer for the purpose of attaining a better effect. Alternatively, it is also possible to use a method wherein an acrylic monomer such as urethane acrylate, polyester acrylate, epoxy acrylate or polyether acrylate is added and the mixture is subjected to crosslinking with an ultraviolet radiation or an electron beam.

The thermal transfer image-receiving sheet according to the present invention can be produced by coating at least one surface of the above-described substrate sheet with a suitable organic solvent solution or water or organic solvent dispersion of the above-described polycarbonate resin and aromatic polyester resin optionally containing necessary additives, for example, a release agent, a crosslinking agent, a curing agent, a catalyst, a heat release agent, an ultraviolet absorber, an antioxidant and a photostabilizer, for example, by a gravure printing method, a screen printing method or a reverse roll coating method wherein use is made of a gravure print, and drying the resultant coating to form a dye-receiving layer.

In the formation of the receiving layer, it is possible to add pigments or fillers such as titanium oxide, zinc oxide, kaolin clay, calcium carbonate and finely divided silica for the purpose of further enhancing the sharpness of a transferred image through an improvement in the whiteness of the receiving layer.

Although the thickness of the dye-receiving layer formed by the above-described method may be arbitrary, it is generally in the range of from 1 to 50 μm. It is preferred for the dye-receiving layer to comprise a continuous coating. However, the dye-receiving layer may be formed as a discontinuous coating through the use of a resin emulsion or a resin dispersion.

The image-receiving sheet of the present invention can be applied to various applications where thermal transfer recording can be conducted, such as cards and sheets for preparing transparent originals, by properly selecting the substrate sheet.

Further, in the image-receiving sheet of the present invention, a cushion layer may be optionally provided between the substrate sheet and the receiving layer, and the provision of the cushion layer enables an image less susceptible to noise during printing and corresponding to image information to be formed by transfer recording with a good reproducibility.

Examples of the resin used in the cushion layer include polyurethane, polybutadiene, polyacrylate, polyester, epoxy resin, polyamide, rosin-modified phenol, terpene phenol resin, ethylene/vinyl acetate copolymer resin. These resins may be used alone or in the form of a mixture of two or more of them.

The thermal transfer sheet for use in the case where thermal transfer is conducted through the use of the above-described thermal transfer sheet of the present invention comprises a paper or a polyester film and, provided thereon, a dye layer containing a sublimable dye, and any conventional thermal transfer sheet, as such, may be used in the present invention.

Means for applying a thermal energy at the time of the thermal transfer may be any means known in the art. For example, a desired object can be sufficiently attained by applying a thermal energy of about 5 to 100 $mJ/mm^2$ through the control of a recording time by means of a recording device, for example, a thermal printer (for example, a video printer VY-100 manufactured by Hitachi, Limited).

The present invention will now be described in more detail with reference to the following Examples and Comparative Examples. In the Examples and Comparative Examples, "parts" or "%" is by weight unless otherwise specified.

EXAMPLES A1 TO A15 AND COMPARATIVE EXAMPLES A1 TO A5

Synthetic paper (Yupo-FPG-150 (thickness: 150 μm) manufactured by Oji-Yuka Synthetic Paper Co., Ltd.) was used as the substrate sheet, and a coating solution having the following composition was coated by means of a bar coater on one surface of the synthetic paper so that the coverage on a dry basis was 5.0 $g/m^2$, and the resultant coating was dried to provide thermal transfer sheets of the present invention and comparative thermal transfer sheets.

| Composition of coating solution | |
|---|---|
| Polycarbonate resin listed in Table A1 and polycarbonate resin for comparative example | 10 parts |
| Catalytic crosslinking silicone (X-62-1212 manufactured by The Shin-Etsu Chemical Co., Ltd.) | 1 part |
| Platinum-based curing catalyst (PL-50T manufactured by The Shin-Etsu Chemical Co., Ltd.) | 0.1 part |
| Methyl ethyl ketone/toluene (weight ratio = 1/1)* | 89 parts |

Note) *In Comparative Exampled A1, chloroform was used as the solvent, and in Comparative Example A3, 5 parts of chloroform was further added because the resin was not completely dissolved.

TABLE A1

| Ex. No. | A | $R^1$ | $R^2$ | $R^3$ | $R^4$ | B | $R^5$ | $R^6$ | $R^7$ | $R^8$ | Copolymerization ratio | Number average molecular weight |
|---|---|---|---|---|---|---|---|---|---|---|---|---|
| A1 | $-C(CH_3)_2-$ | H | H | H | H | —O— | H | H | H | H | 50/50 | 14,200 |
| A2 | $-C(CH_3)_2-$ | H | H | H | H | —O— | H | H | H | H | 50/50 | 8,500 |
| A3 | $-C(CH_3)_2-$ | H | H | H | H | —O— | H | H | H | H | 50/50 | 31,000 |
| A4 | $-C(CH_3)_2-$ | H | H | H | H | —O— | H | H | H | H | 70/30 | 12,300 |
| A5 | $-C(CH_3)_2-$ | H | H | H | H | —O— | H | H | H | H | 30/70 | 24,000 |

TABLE A1-continued

| Ex. No. | A | $R^1$ | $R^2$ | $R^3$ | $R^4$ | B | $R^5$ | $R^6$ | $R^7$ | $R^8$ | Copolymerization ratio | Number average molecular weight |
|---|---|---|---|---|---|---|---|---|---|---|---|---|
| A6 | $-C(CH_3)_2-$ | H | H | H | H | —O— | H | H | H | H | 40/60 | 11,500 |
| A7 | $-C(CH_3)_2-$ | H | H | H | H | —O— | H | H | H | H | 60/40 | 16,000 |
| A8 | $-C(CH_3)_2-$ | H | H | H | H | —S— | H | H | H | H | 50/50 | 22,100 |
| A9 | $-C(CH_3)_2-$ | H | H | H | H | —S— | H | H | H | H | 65/35 | 12,000 |
| A10 | cyclohexyl-1,1-bis | H | H | H | H | —O— | H | H | H | H | 40/60 | 11,400 |
| A11 | cyclohexyl-1,1-bis | H | H | H | H | —O— | H | H | H | H | 50/50 | 26,000 |
| A12 | cyclohexyl-1,1-bis | H | H | H | H | —S— | H | H | H | H | 60/40 | 12,200 |
| A13 | $-C(CH_3)_2-$ | H | $-CH_3$ | H | $-CH_3$ | —O— | H | H | H | H | 50/50 | 18,000 |
| A14 | $-C(CH_3)_2-$ | H | H | H | H | —O— | H | $-CH_3$ | H | $-CH_3$ | 50/50 | 10,500 |
| A15 | $-C(CH_3)_2-$ | H | H | H | H | —S— | H | $-CH_3$ | H | $-CH_3$ | 50/50 | 13,300 |

Comparative Example A1

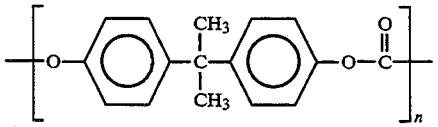

Molecular weight = 14,200

| Ink composition | |
|---|---|
| Cyan dye represented by the following structural formula | 4.00 parts |
| Polyvinyl butyral resin (S-lec manufactured by Sekisui Chemical Co., Ltd.) | 3.00 parts |
| Methyl ethyl ketone | 46.5 parts |
| Toluene | 46.5 parts |

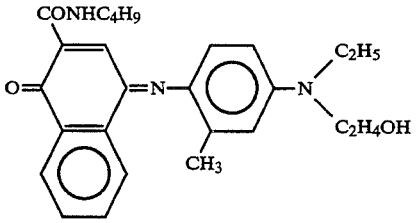

Thermal transfer test

The above-described thermal transfer sheet and the above-described thermal transfer image-receiving sheet of the present invention or comparative thermal transfer image-receiving sheet were put one on top of the other in such a manner that the dye layer and the dye receiving surface faced each other. Recording of a cyan image was conducted by means of a thermal head from the back surface of the thermal transfer sheet under conditions of a head applied voltage of 12.0 V, a step pattern wherein the applied pulse width is successively reduced from 16 msec/line every 1 msec, and a 6 lines/mm (33.3 msec/line) in the sub-scanning direction, and various types of durability were then determined. The results are given in the following Table A2. Various types of durability given in Table A2 were evaluated by the following methods.

(1) Light fastness test:

Irradiation was conducted by means of a xenon fadeometer (Ci-35A manufactured by Atlas) at 100 $KJ/m^2$(420 run), the change in the optical density between before irradiation and after irradiation was measured by means of an optical densitometer (RD-918 manufactured Mcbeth), and the retention of the optical density was determined according to the following equation.

Retention (%) = {[optical density after irradiation] / [optical density before irradiation]} × 100

○: Retention was 85% or more.

Δ: Retention was 80 to 85% exclusive.

X: Retention was less than 80%.

(2) Evaluation of fingerprint resistance:

A finger was pressed against the surface of the print to leave a fingerprint, and the print was allowed to stand at room temperature for 5 days. Then, the discoloration and change in the density of the fingerprinted portion was evaluated with the naked eye.

A: Substantially no difference was observed between the fingerprinted portion and the non-fingerprinted portion.

B: A discoloration or a change in the density was observed.

C: Loss of whiteness occurred in the fingerprinted portion to such an extent that the shape of the fingerprint was clearly observed.

D: Loss of whiteness centered on the fingerprinted portion occurred and, at the same time, agglomeration of the dye was observed.

(3) Evaluation of plasticizer resistance:

An identical portion of the surface of the print was lightly rubbed with a commercially available eraser twice or three times, and the change in the density was evaluated with the naked eye.

○: Substantially no change in the density was observed.

Δ: Change in the density was observed.

X: The density was greatly changed, and loss of whiteness occurred from the low density portion to the medium density portion.

TABLE A2

| | Light fastness | Fingerprint resistance | Plasticizer resistance |
|---|---|---|---|
| Ex. A1 | ∘ | A | ∘ |
| Ex. A2 | ∘ | A | ∘ |
| Ex. A3 | ∘ | A | ∘ |
| Ex. A4 | ∘ | A | ∘ |
| Ex. A5 | ∘ | A | ∘ |
| Ex. A6 | ∘ | A | ∘ |
| Ex. A7 | ∘ | A | ∘ |
| Ex. A8 | ∘ | A | ∘ |
| Ex. A9 | ∘ | A | ∘ |
| Ex. A10 | ∘ | A | ∘ |
| Ex. A11 | ∘ | A | ∘ |
| Ex. A12 | ∘ | A | ∘ |
| Ex. A13 | ∘ | A | ∘ |
| Ex. A14 | ∘ | A | ∘ |
| Ex. A15 | ∘ | A | ∘ |
| Comp. Ex. A1 | ∘ | B | Δ |
| Comp. Ex. A2 | ∘ | C | Δ |
| Comp. Ex. A3 | ∘ | C | Δ |
| Comp. Ex. A4 | ∘ | C | Δ |
| Comp. Ex. A5 | X | D | X |

As described above, the formation of a dye-receiving layer through the use of a polycarbonate resin having a particular structure can provide a thermal transfer image-receiving sheet which can form an image excellent in the coloring density, sharpness and various types of fastness, particularly durability such as light fastness, fingerprint resistance and plasticizer resistance, and can be easily produced by conventional coating equipment through the use of a non-halogenated hydrocarbon solvent, such as a ketone solvent, a toluene solvent or a mixture thereof.

EXAMPLES B1 TO B22

Synthetic paper (Yupo-FPG-150 (thickness: 150 μm) manufactured by Oji-Yuka Synthetic Paper Co., Ltd.) was used as the substrate sheet, and a coating solution having the following composition was coated by means of a bar coater on one surface of the synthetic paper so that the coverage on a dry basis was 5.0 g/m$^2$, and the resultant coating was dried to provide thermal transfer sheets of the present invention.

| Composition of coating solution | |
|---|---|
| Polycarbonate resin listed in Table B1 | 5 parts |
| Polyester resin prepared from components listed in Table B2 | 5 parts |
| Catalytic crosslinking silicone (X-62-1212 manufactured by The Shin-Etsu Chemical Co., Ltd.) | 1 part |
| Platinum-based curing catalyst (PL-50T manufactured by The Shin-Etsu Chemical Co., Ltd.) | 0.1 part |

-continued

| Composition of coating solution | |
|---|---|
| Methyl ethyl ketone/toluene (weight ratio = 1/1)* | 89 parts |

Note) *When the resin was insoluble in the solvent, chloroform was properly added as an additional solvent.

TABLE B1

PC-1

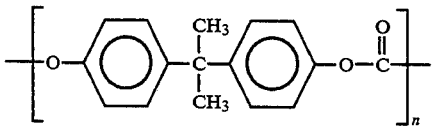

Number average molecular weight = 14,200

PC-2

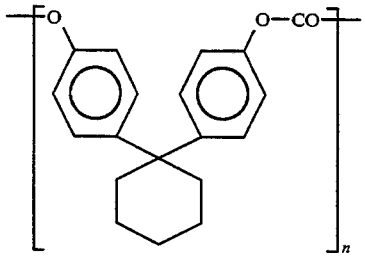

Number average molecular weight = 15,500

PC-3

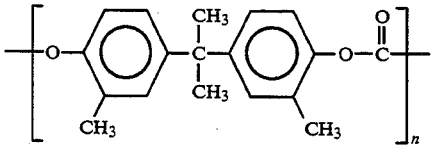

Number average molecular weight = 12,600

PC-4–PC-9

General formula (1)

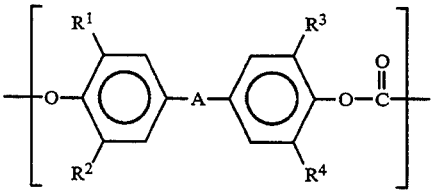

General formula (2)

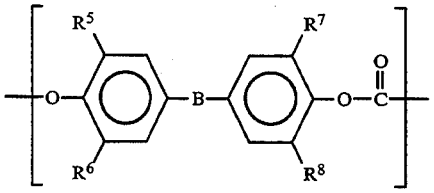

Copolymer comprising a structural unit represented by the above general formula (1) and a structural unit represented by the above general formula (2).

| Ex. No. | A | $R^1$ | $R^2$ | $R^3$ | $R^4$ | B | $R^5$ | $R^6$ | $R^7$ | $R^8$ | Copolymerization ratio | Number average molecular weight |
|---|---|---|---|---|---|---|---|---|---|---|---|---|
| 4 | —C(CH$_3$)$_2$— | H | H | H | H | —O— | H | H | H | H | 50/50 | 14,200 |

-continued

| Ex. No. | A | $R^1$ | $R^2$ | $R^3$ | $R^4$ | B | $R^5$ | $R^6$ | $R^7$ | $R^8$ | Copolymerization ratio | Number average molecular weight |
|---|---|---|---|---|---|---|---|---|---|---|---|---|
| 5 | $-C(CH_3)_2-$ | H | H | H | H | —O— | H | H | H | H | 70/30 | 12,300 |
| 6 | $-C(CH_3)_2-$ | H | H | H | H | —O— | H | H | H | H | 30/70 | 24,000 |
| 7 | $-C(CH_3)_2-$ | H | H | H | H | —S— | H | H | H | H | 50/50 | 22,100 |
| 8 | cyclohexyl-1,1-bis | H | H | H | H | —O— | H | H | H | H | 40/60 | 11,400 |
| 9 | $-C(CH_3)_2-$ | H | $-CH_3$ | $-CH_3$ | H | —O— | H | H | H | H | 50/50 | 18,000 |

TABLE B2

| No. | Components | Amount of use | Reduced viscosity $\eta^{sp}/C$ |
|---|---|---|---|
| PEs-1 | neopentyl glycol | 50 mol | 0.53 |
| | ethylene glycol | 50 mol | |
| | terephthalic acid | 50 mol | |
| | isophthalic acid | 50 mol | |
| PEs-2 | neopentyl glycol | 50 mol | 0.54 |
| | ethylene glycol | 50 mol | |
| | terephthalic acid | 47 mol | |
| | isophthalic acid | 42 mol | |
| | sebacic acid | 11 mol | |
| PEs-3 | ethylene glycol | 65 mol | 0.50 |
| | cyclohexanedimethanol | 35 mol | |
| | terephthalic acid | 100 mol | |
| PEs-4 | ethylene glycol | 65 mol | 0.49 |
| | cyclohexanedimethanol | 35 mol | |
| | terephthalic acid | 50 mol | |
| | isophthalic acid | 50 mol | |
| PEs-5 | ethylene glycol | 70 mol | 0.41 |
| | cyclohexanedimethanol | 30 mol | |
| | terephthalic acid | 50 mol | |
| | cyclohexanedicarboxylic acid | 50 mol | |
| PEs-6 | TCD-M | 40 mol | 0.52 |
| | ethylene glycol | 60 mol | |
| | terephthalic acid | 50 mol | |
| | isophthalic acid | 48 mol | |
| | trimellitic acid | 2 mol | |
| PEs-7 | TCD-M | 20 mol | 0.46 |
| | neopentyl glycol | 20 mol | |
| | ethylene glycol | 60 mol | |
| | terephthalic acid | 50 mol | |
| | isophthalic acid | 48.5 mol | |
| | sebacic acid | 1.5 mol | |
| PEs-8 | TCD-M | 50 mol | 0.29 |
| | neopentyl glycol | 25 mol | |
| | ethylene glycol | 25 mol | |
| | terephthalic acid | 47 mol | |
| | isophthalic acid | 42 mol | |
| | sebacic acid | 11 mol | |
| PEs-9 | TCD-M | 20 mol | 0.36 |
| | cyclohexanedimethanol | 20 mol | |
| | ethylene glycol | 60 mol | |
| | terephthalic acid | 50 mol | |
| | isophthalic acid | 50 mol | |
| PEs-10 | TCD-M | 50 mol | 0.40 |
| | ethylene glycol | 50 mol | |
| | terephthalic acid | 50 mol | |
| | isophthalic acid | 50 mol | |
| PEs-11 | cyclohexanedimethanol | 40 mol | 0.56 |
| | ethylene glycol | 60 mol | |
| | terephthalic acid | 45 mol | |
| | isophthalic acid | 45 mol | |
| | cyclohexanedicarboxylic acid | 10 mol | |
| PEs-12 | TCD-M | 40 mol | 0.23 |
| | ethylene glycol | 20 mol | |
| | BPE-20 (bisphenol) | 40 mol | |
| | terephthalic acid | 50 mol | |

TABLE B2-continued

| No. | Components | Amount of use | Reduced viscosity $\eta^{sp}/C$ |
|---|---|---|---|
| | isophthalic acid | 50 mol | |

Note) BPE-20 has a structure represented by the following formula:

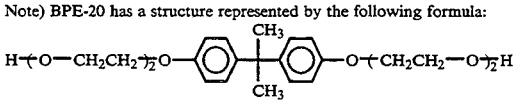

An ink composition for forming a dye-supporting layer was prepared according to the following formulation, coated by means of a gravure printing method on a 6 μm-thick polyethylene terephthalate film having a reverse face subjected to a treatment for rendering the face heat-resistant so that the coverage on a dry basis was 1.0 g/m², and the resultant coating was dried to provide thermal transfer sheets.

| Ink composition | |
|---|---|
| Cyan dye represented by the following structural formula | 4.00 parts |
| Polyvinyl butyral resin (S-lec BX-1 manufactured by Sekisui Chemical Co., Ltd.) | 3.00 parts |
| Methyl ethyl ketone | 46.6 parts |
| Toluene | 46.5 parts |

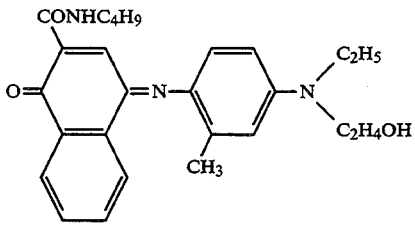

Thermal transfer test

The above-described thermal transfer sheet and the above-described thermal transfer image-receiving sheet of the present invention were put one on top of the other in such a manner that the dye layer and the dye receiving surface faced each other. Recording of a cyan image was conducted by means of a thermal head from the back surface of the thermal transfer sheet under conditions of a head applied voltage of 11.0 V, a step pattern wherein the applied pulse width is successively reduced from 16 msec/line every 1 msec, and a 6 lines/mm (33.3 msec/line) in the sub-scanning direction, and various types of durability of the formed image was then determined. The results are given in the following Table B3. Various types of durability given in Table B3 were evaluated by the following methods.

(1) Light fastness test:

Irradiation was conducted by means of a xenon fadeometer (Ci-35A manufactured by Atlas) at 100 $KJ/m^2$(420 nm), the change in the optical density between before irradiation and after irradiation was measured by means of an optical densitometer (RD-918 manufactured by Mcbeth), and the retention of the optical density was determined according to the following equation.

Retention (%) = {[optical density after irradiation] / [optical density before irradiation]} × 100

A: Retention was 90% or more.

B: Retention was 85 to 90% exclusive.

C: Retention was 80 to 85% exclusive.

D: Retention was less than 80%.

(2) Evaluation of fingerprint resistance:

A finger was pressed against the surface of print to leave a fingerprint, and the print was allowed to stand at room temperature for 5 days. Then, the discoloration and change in the density of the fingerprinted portion was evaluated with the naked eye.

A: Substantially no difference was observed between the fingerprinted portion and the non-fingerprinted portion.

B: A discoloration or a change in the density was observed.

C: Loss of whiteness occurred in the fingerprinted portion to such an extent that the shape of the fingerprint was clearly observed.

D: Loss of whiteness centered on the fingerprinted portion occurred and, at the same time, agglomeration of the dye was observed.

(3) Evaluation of plasticizer resistance:

An identical portion of the surface of the print was lightly rubbed with a commercially available eraser five times, and the change in the density was evaluated with the naked eye.

A: Substantially no change in the density was observed.

B: Change in the density was observed.

C: The density was greatly changed, and loss of whiteness occurred from the low density portion to the medium density portion.

TABLE B3

| | Polycarbonate resin | Polyester | Overall evaluation | Light fastness | Finger print resistance | Plasticizer resistance |
|---|---|---|---|---|---|---|
| Ex.B1 | PC-1 | PEs-3 | ◎ | A | A | A |
| Ex.B2 | PC-2 | PEs-1 | ○ | A | B | A |
| Ex.B3 | PC-2 | PEs-9 | ◎ | A | A | A |
| Ex.B4 | PC-3 | PEs-2 | ∘ | A | B | A |
| Ex.B5 | PC-4 | PEs-1 | ◎ | A | A | A |
| Ex.B6 | PC-4 | PEs-9 | ◎ | A | A | A |
| Ex.B7 | PC-4 | PEs-10 | ◎ | A | A | A |
| Ex.B8 | PC-4 | PEs-11 | ◎ | A | A | A |
| Ex.B9 | PC-5 | PEs-2 | ◎ | A | A | A |
| Ex.B10 | PC-5 | PEs-4 | ◎ | A | A | A |
| Ex.B11 | PC-5 | PEs-9 | ◎ | A | A | A |
| Ex.B12 | PC-6 | PEs-6 | ◎ | A | A | A |
| Ex.B13 | PC-6 | PEs-8 | ○ | A | A | B |
| Ex.B14 | PC-6 | PEs-10 | ◎ | A | A | A |
| Ex.B15 | PC-7 | PEs-5 | ◎ | A | A | A |
| Ex.B16 | PC-7 | PEs-7 | ◎ | A | A | A |
| Ex.B17 | PC-7 | PEs-9 | ◎ | A | A | A |

TABLE B3-continued

| | Polycarbonate resin | Polyester | Overall evaluation | Light fastness | Finger print resistance | Plasticizer resistance |
|---|---|---|---|---|---|---|
| Ex.B18 | PC-8 | PEs-5 | ◎ | A | A | A |
| Ex.B19 | PC-8 | PEs-8 | ○ | A | A | B |
| Ex.B20 | PC-8 | PEs-11 | ◎ | A | A | A |
| Ex.B21 | PC-9 | PEs-7 | ◎ | A | A | A |
| Ex.B22 | PC-4 | PEs-12 | ○ | A | A | B |

COMPARATIVE EXAMPLES B1 TO B5

An image was formed and evaluated in the same manner as that of Example B1, except that the following coating solution was used instead of the coating solution for a receiving layer in Example B1. The results are given in Table B4.

| Composition of coating solution | |
|---|---|
| Polycarbonate resin listed in Table B4 | 10 parts |
| Catalytic crosslinking silicone (X-62-1212 manufactured by The Shin-Etsu Chemical Co., Ltd.) | 1 part |
| Platinum-based curing catalyst (PL-50T manufactured by The Shin-Etsu Chemical Co., Ltd.) | 0.1 part |
| Methyl ethyl ketone/toluene (weight ratio = 1/1)* | 89 parts |

Note) *When the resin was insoluble in the solvent, chloroform was properly added as an additional solvent.

TABLE B4

| | Resin | Overall evaluation | Light fastness | Finger-print resistance | Thermo-plasticizer resistance |
|---|---|---|---|---|---|
| Comp. Ex.B1 | PC-1 | Δ | A | B | B |
| Comp. Ex.B2 | PC-2 | X | A | C | B |
| Comp. Ex.B3 | PEs-2 | X | C | B | B |
| Comp. Ex.B4 | PEs-4 | Δ | B | A | A |
| Comp. Ex.B5 | * | X | A | D | C |

*Polyvinylacetal resin (S-lec KS-1 manufactured by Sekisui Chemical Co., Ltd.)

As described above, the formation of a dye-receiving layer through the use of a polycarbonate resin and an aromatic polyester resin can provide a thermal transfer image-receiving sheet which can form an image excellent in the coloring density, sharpness and various types of fastness, particularly durability such as light fastness, fingerprint resistance and plasticizer resistance and can be easily produced by conventional coating equipment through the use of a non-halogenated hydrocarbon solvent, such as a ketone solvent, a toluene solvent or a mixture thereof.

What is claimed is:

1. A thermal transfer image-receiving sheet comprising a substrate sheet and a dye-receiving layer formed on at least one surface of the substrate sheet, wherein said dye-receiving layer comprises an aromatic polyester resin and a random copolycarbonate resin having structural units represented by the following general formulae (1) and (2), the molar ratio of the structural unit represented by the general formula (1) to the structural unit represented by the general formula (2) being 30:70 to 70:30

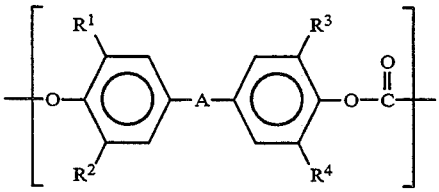

(1)

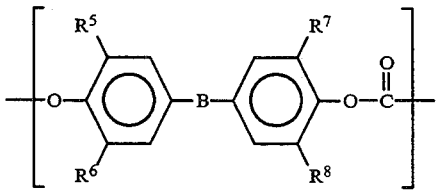

(2)

wherein $R^1$ to $R^8$ stand for hydrogen, a halogen or an alkyl group having 1 to 4 carbon atoms, A stands for a straight-chain, branched or cyclic alkylidene group having 1 to 10 carbon atoms, an aryl group or a sulfonyl group and B stands for an oxygen atom or a sulfur atom.

2. A thermal transfer image-receiving sheet according to claim 1, wherein said copolycarbonate resin has a number average molecular weight of 5,000 to 50,000.

3. A thermal transfer image-receiving sheet according to claim 1, wherein at least one of a diol moiety and an acid moiety constituting said aromatic polyester resin contains an alicyclic compound.

4. A thermal transfer image-receiving sheet comprising a substrate sheet and a dye-receiving layer formed on at least one surface of the substrate sheet, said dye-receiving layer comprising at least a random copolycarbonate reins and an aromatic polyester resin, said random copolycarbonate resin having structural units represented by the following general formulae (1) and (2), the molar ratio of the structural unit represented by the general formula (1) to the structural unit represented by the general formula (2) being 30:70 to 70:30

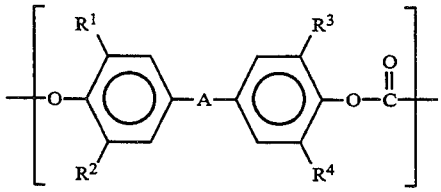

(1)

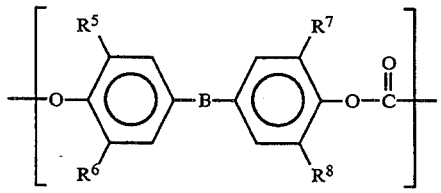

(2)

wherein $R^1$ to $R^8$ stand for hydrogen, a halogen or an alkyl group having 1 to 4 carbon atoms, A stands for a straight-chain, branched or cyclic alkylidene group having 1 to 10 carbon atoms, an aryl-substituted alkylidene group, an aryl group or a sulfonyl group and B stands for an oxygen atom or a sulfur atom.

5. A thermal transfer image-receiving sheet according to claim 4, wherein said polycarbonate resin has a number average molecular weight of 5,000 to 50,000.

6. A thermal transfer image-receiving sheet according to claim 4, wherein at least one of a diol moiety and an acid moiety constituting said aromatic polyester resin contains an alicyclic compound.

7. A thermal transfer image-receiving sheet according to claim 6, wherein said alicyclic compound is tricyclodecanedimethanol, cyclohexanedicarboxylic acid, cyclohexanedimethanol or cyclohexanediol.

8. A thermal transfer image-receiving sheet according to claim 4, wherein said aromatic polyester resin has a molecular weight in the range of from 2,000 to 30,000 in terms of number average molecular weight.

9. A thermal transfer image-receiving sheet according to claim 4, wherein the diol moiety of the aromatic polyester resin is a mixture of an alicyclic diol with other diol.

10. A thermal transfer image-receiving sheet according to claim 9, wherein ethylene glycol occupies 60 mole % or more of the diol moiety.

11. An imaging system, comprising:

a thermal transfer sheet including a dye layer; and a thermal transfer image-receiving sheet comprising a substrate sheet and a dye-receiving layer formed on at least one surface of the substrate sheet, wherein said dye-receiving layer comprises a random copolycarbonate resin having structural units represented by the following general formulae (1) and (2), the molar ratio of the structural unit represented by the general formula (1) to the structural unit represented by the general formula (2) being 30:70 to 70:30

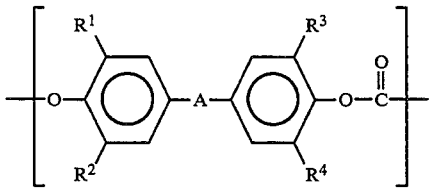

(1)

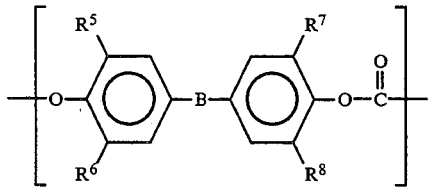

(2)

wherein $R^1$ to $R^8$ stand for hydrogen, a halogen or an alkyl group having 1 to 4 carbon atoms, A stands for a straight-chain, branched or cyclic alkylidene group having 1 to 10 carbon atoms, an aryl-substituted alkylidene group, an aryl group or a sulfonyl group and B stands for an oxygen atom or a sulfur atom.

* * * * *